United States Patent [19]

Nodfelt

[11] Patent Number: 4,810,202

[45] Date of Patent: Mar. 7, 1989

[54] CONNECTOR DEVICE

[75] Inventor: Ingvar Nodfelt, Gnosjo, Sweden

[73] Assignee: AB Stratos, Gnosjo, Sweden

[21] Appl. No.: 139,176

[22] Filed: Dec. 28, 1987

Related U.S. Application Data

[63] Continuation of Ser. No. 29,378, Mar. 23, 1987, abandoned, which is a continuation of Ser. No. 875,260, Jun. 17, 1986, abandoned, which is a continuation of Ser. No. 775,718, Sep. 16, 1985, abandoned, which is a continuation of Ser. No. 600,123, Apr. 13, 1984, abandoned.

[30] Foreign Application Priority Data

Apr. 14, 1983 [SE] Sweden ..... 8302077

[51] Int. Cl.[4] ..... H01R 13/28

[52] U.S. Cl. ..... 439/289; 439/38; 439/132; 439/205; 439/310; 439/272

[58] Field of Search ..... 339/12 R, 12 G, 75 R, 339/75 M, 94 R, 94 C, 94 A, 94 M, 117 R, 117 P, 34, 35; 439/38, 39, 131, 132, 271–277, 205, 206, 296, 310, 289

[56] References Cited

U.S. PATENT DOCUMENTS

| | | | |
|---|---|---|---|
| 2,700,141 | 1/1955 | Jones | 339/94 M |
| 2,724,093 | 11/1955 | Preston | 339/34 |
| 3,383,468 | 5/1968 | Bryan et al. | 339/34 |
| 3,519,975 | 7/1970 | Prow, Jr. et al. | 339/94 M |
| 3,635,184 | 1/1972 | Liautaud | 339/75 M |
| 3,945,699 | 3/1976 | Westrom | 339/12 R |
| 4,073,562 | 2/1978 | Karlskind | 339/117 P |
| 4,109,989 | 8/1978 | Snyder, Jr. et al. | 339/117 R |
| 4,299,431 | 11/1981 | Wilson et al. | 339/117 R |

*Primary Examiner*—David Pirlot

*Attorney, Agent, or Firm*—Holman & Stern

[57] ABSTRACT

A connector device for connecting two electrically conductive contact members (16, 54) with each other comprises two releasably connectable connector members (2, 4), each of the connector members including one of the contact members, the connector device further having parts (20, 40, 42, 44, 58, 82, 84, 86) for sealingly enclosing the contact members (16, 54) in the connector members (2, 4), and a device (20, 22, 58, 26, 62, 30, 32, 34, 36, 64) for selectively establishing electrical contact between the contact members (16, 54) and breaking this contact after the connector members have been connected with each other.

9 Claims, 5 Drawing Sheets

CONNECTOR DEVICE

This is a continuation of application 029,378, filed Mar. 23, 1987, abandoned, which in turn is the continuation of U.S. Ser. No. 875,260, filed June 17, 1986 (abandoned), which is a continuation of U.S. Ser. No. 775,718, filed Sep. 16, 1985 (abandoned), which is a continuation of U.S. Ser. No. 600,123, filed Apr. 13, 1984 (abandoned).

BACKGROUND OF THE INVENTION

1. Field of the Invention

The present invention relates to a connector device for connecting two electrically conductive contact members to each other.

2. Description of the Prior Art

The most common type of a connector device of this kind comprises two releasably connectable connector members, each including one of the electrically conductive contact members which are electrically interconnected as a direct consequence of the connection of the connector members with each other. Previously known connector devices of this type can be adapted to underwater use only by means of complicated additional equipment which is difficult to handle. Thus, there does not exist any connector device for connecting two electrically conductive contact members with each other, which is of a simple and reliable construction and per se complies with the requirement for sealing the contact members in relation to the environment before as well as after the establishment of an electrical contact between the contact members, which requirement is necessary to fullfil in a connector device adapted for underwater use.

BRIEF SUMMARY OF THE INVENTION

The object of the invention is to provide a connector device which, by the fact that it complies with the above requirements and demands, is especially well suited for underwater use and for other applications in which it is important that the contact members of the connector device do not contact the environment.

In order to comply with this object the connector device according to the invention comprises devices for sealingly enclosing the contact members in each connector member and further comprises a device for selectively establishing electrical contact between the contact member and disconnecting said contact, after the connector members have been connected with each other.

In a preferred embodiment of the invention the device for selectively establishing and disconnecting electrical contact between the contact members comprises an electrically conductive connector element which is positioned in one of the connector members and is displaceable between a position in which the connector element is retracted in said connector member and a position in which the connector element partly projects into the other connector member, said connector element electrically connecting the contact members with each other in said last mentioned position. It is suitable that the electrically conductive connector element can be controlled by means of an electromagnetic device.

In a preferred embodiment of the connector device according to the invention the contact members are at least partially enclosed by separate portions of a sleeve which is axially displaceable in relation to the contact members, said portions of the sleeve being adapted endwise to engage each other when the connector members are in their interconnected position, the connector element being constituted by an electrically conductive part of one of the portions of the sleeve.

Thus, in a connector device according to the invention there is not established any electrical contact between the contact members as a consequence of the connection of the connector members but the contact is established in taking a special action for providing the electrical contact between the contact members.

When using the connector device according to the invention in water the construction of the connector device prevents the water from contacting the contact members of the connector device when the connector members are separated as well as when the connector members are interconnected.

BRIEF DESCRIPTION OF THE DRAWINGS

The inention will now be described in detail with reference to the accompanying drawings, wherein.

DETAILED DESCRIPTION

Figure 1:
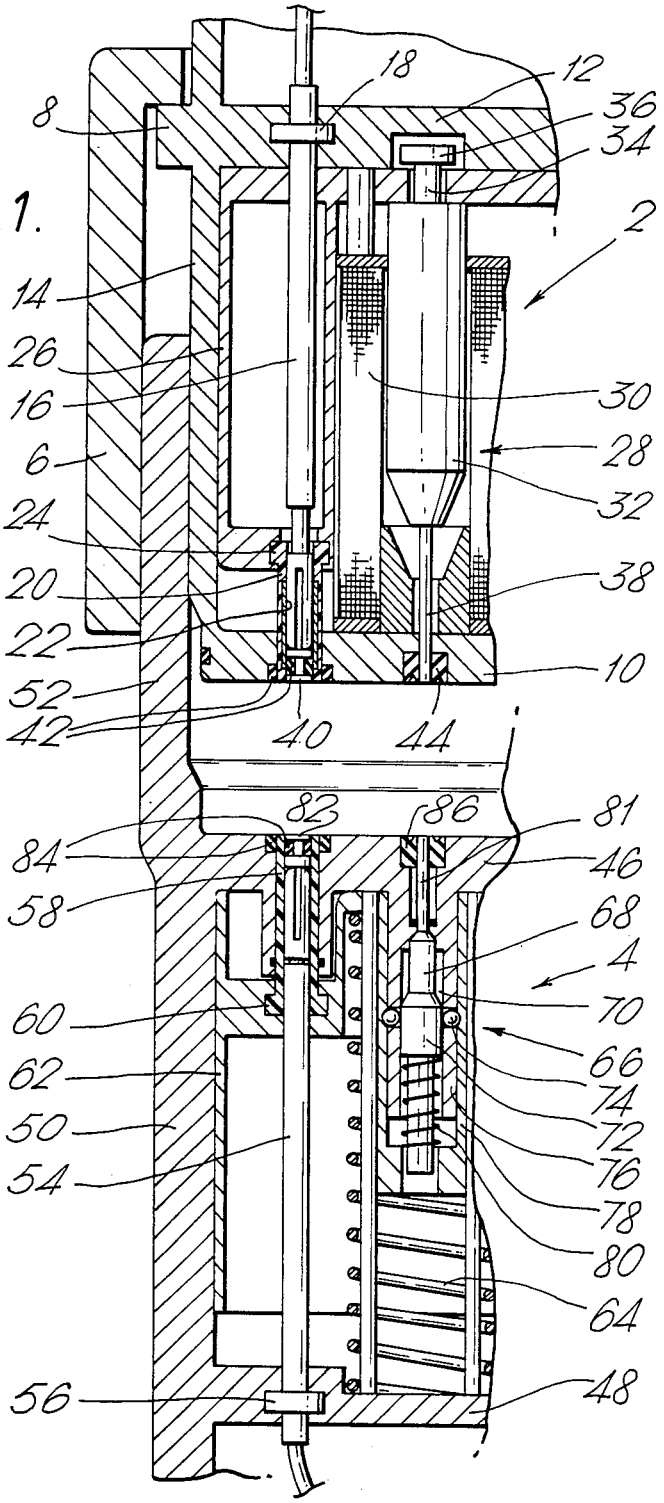
FIG. 1 is an axial cross-sectional view of a connector device according to the invention, the connector members of the connector device being positioned at a distance from each other.

The connector device according to the invention and shown in axial section in FIG. 1 comprises a male connector member 2 and a female connector member 4, the connector members 2 and 4 being connectable with each other. In the interconnected position the connector members 2 and 4 are retained in said position by means of a collar nut 6 engaging a flange 8 on the connector member 2 and cooperating with a thread (not shown0 on the connector member 4.

The connector members 2 and 4 are of substantially cylindrical shape and the connector member 2 has an outer end wall 10, an inner end wall 12 and a cylindrical wall 14 connecting said end walls. A tap-shaped contact member 16 is positioned in the connector member 2, a flange 18 on the contact member 16 being enclosed by the inner end wall 12. The connector member 2 is symmetrically constructed with regard to its center axis and the right part of the connector member 2 is constructed in the same way as the left part of the connector member, that is, comprises e.g., a contact member of the same kind as the contact member 16.

The end portion of the contact member 16 positioned adjacent the end wall 10 is enclosed by a sleeve portion 20 having an electrically conductive portion 22 but the other portion consisting of an electrically insulating material. The inner end of the sleeve portion 20 has a flange 24 which is mounted in an inner portion 26 movable as a piston in the connector member 2 and having its outer periphery guided against the inner surface of the cylindrical wall 14.

In the center of the connector member 2 there is provided an electromagnetic device 28 comprising an electromagnet 30 and a control member 32 operated by the electromagnet and positioned in the center thereof. At its upper end in the figure the control member 32 has an engagement portion 34 extending through a wall of the inner portion 26 and having outside this wall an enlarged portion 36 which is adapted to engage the inner portion 26 and displace this portion and thereby the sleeve portion 20 to a position in which the inner portion 26 contacts the inner surface of the end wall 10 and the sleeve portion 20 partially projects from the outer surface of the end wall 10, when the control member 32 is displaced downwards according to the figure. The displacement of the control member 32 and thereby of the inner portion 26 and the sleeve portion 20 is provided by activating the electromagnet 30. The control member 32 is provided with a control pin 38 which projects from the outer surface of the end wall 10 when the control member 32 is displaced downwards according to FIG. 1.

The sleeve portion 20 and the control pin 38 extend through openings in the end wall 10, and these openings are sealed by means of an insulating peg 40 and gaskets 42 and 44 consisting of elastic material, for example rubber. Because of the fact that the end surface of the sleeve portion 20 positioned at the outer surface of the end wall 10 consists of electrically insulating material the contact member 16 is in electrical respect insulated from the environment in the position shown in FIG. 1.

The connector member 4 has an outer end wall 46, an inner end wall 48, a substantially cylindrical wall 50 connecting the end walls and a projecting portion 52 adapted to engage the nut 6 and the outer surface of the cylindrical wall 14 of the connector member 2. In the connector member 4 there is mounted a contact member 54 having a flange 56 enclosed by the inner end wall 48. The connector member 4 also is symmetrically constructed and comprises a further contact member of the same kind as the contact member 54. The portion of the contact member 54 positioned adjacent the end wall 46 is enclosed by a sleeve portion 58 consisting of an electrically insulating material. The sleeve portion 58 has such a position and such dimensions that it forms together with the sleeve portion 20 of the connector member 2 a continuous sleeve when the connector members 2 and 4 are connected with each other.

The sleeve portion 58 is by means of a flange 60 mounted in an inner portion 62 which is displaceable like a piston in the connector member 4. A spring 64 acts for maintaining the inner portion 62 in the position shown in FIG. 1.

A ball lock 66 is positioned in the center of the connector element 4 and comprises a locking member 68 which is axially displaceable in the connector member 4 and has a portion 70 having a small diameter and a portion 72 a having larger diameter. Balls 74 are positioned in openings in a portion 76 projecting inwardly from the end wall 46. The balls 74 engage recesses in a part 78 of the displaceable inner portion 62. In the position shown in FIG. 1 the portions 76 and 78 are fixed in relation to each other thus providing that the inner portion 62 takes a fixed position in the connector member 4. The portion 72 of the locking member 68 engages the balls in order to retain the balls in the locking position but is displaceable downwardly according to FIG. 1 in order to take a position in which the portion 70 is opposite to the balls 74 and the balls can be displaced from engagement in the recesses in the portion 78. The spring 80 acts for retaining the locking member 68 in the position according to FIG. 1. The locking member 68 supports a control pin 81 which is adapted to cooperate with the control pin 38 of the control member 32 in order to allow operation of the locking member 68 by means of the electromagnetic device 28.

Like the connector member 2 the connector member 4 is sealed by means of an insulating peg 82 and gaskets 84 and 86.

In the position shown in FIG. 1 the contact members 16 and 54 are completely disconnected from electrical contact with the environment. When the connector members 2 and 4 are connected with each other taking a position in which the end walls 10 and 46 contact each other there does not take place any change of the condition of the contact members from the electrical point of view as a consequence of the connection of the connector members. The electrical connection between the connector members 2 and 4 is selectively provided by activating the electromagnetic device 28. When the electromagnetic device 28 is activated the control member 32 is displaced downwards according to FIG. 1, the enlarged portion 36 of the engagement portion 34 thereby acting on the inner portion 26 which displaces the sleeve portion 20 outwardly from the end wall 10 of the connector member 2 into engagement with the end surface of the sleeve portion 58. Thus, the sleeve portion 20 is projected from the end wall 10 of the connector member 2 and the sleeve portion 58 is displaced into the end wall 46 of the connector member 4. In the final position the sleeve consisting of the sleeve portions 20 and 58 takes a position in which the electrically conductive portion 22 electrically connects the contact members 16 and 54 with each other. Because of the fact that the sleeve consisting of the sleeve portions 20 and 58 has an electrically insulating outer surface the sleeve will protect the contact members from electrical contact with the environment also in the position in which the contact members 16 and 54 are electrically connected with each other.

The connector device according to the invention is especially well suited to be used in water at great depths. Thereby the ball lock 66 has the object of obviate the problems which appear because of the fact that there is at great depths required great operating forces for the electromagnetic device 28. Thus, the ball lock 66 provides that the inner portion 62 and thereby the inner portion 26 are locked against displacement during the initial period of the displacement of the control member 32. Not until the control member 32 has moved so far that the locking member 68 has been moved from engagement with the balls 74 through the control pins 38 and 81 can the balls 74 leave their locking position to allow that the control member 32 provides the above described displacement of the inner portions 26 and 62 of the connector members 2 and 4, respectively. It appears from FIG. 1 that the enlarged portion 36 of the engagement portion 34 of the control member 32 is positioned at a distance from the outer surface of the portion of the inner portion 26 which it shall engage so that the engagment does not take place until the locking balls 74 have been displaced from their locking position. Thus, since the control member 32 is in the possession of kinetic energy when the displacement of the movable portions of the connector members 2 and 4 is initiated, the resistance against displacement is overcome in a simple way.

Figure 3:
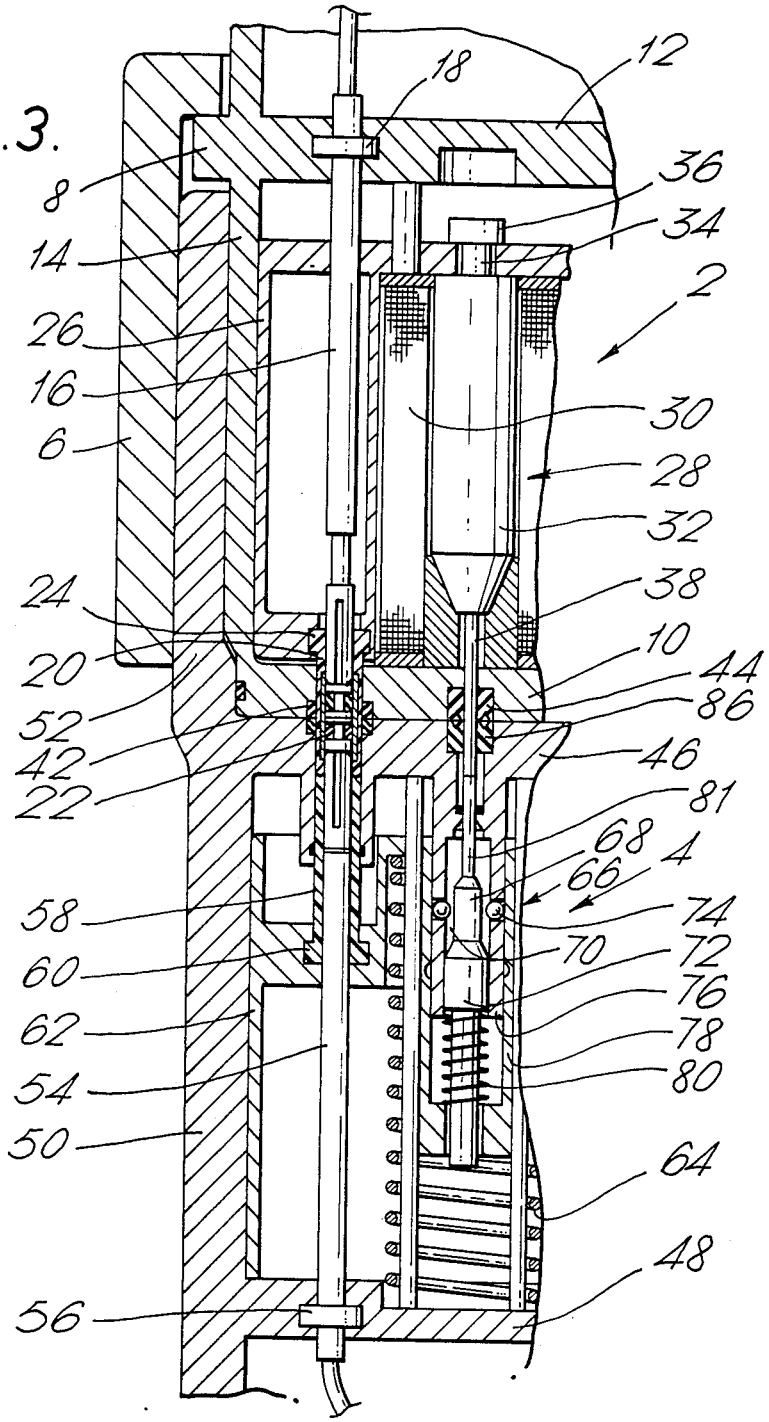
FIG. 3 is an axial cross-section view of the connector device according to FIG. 1, the connector members of the connector device being in a connected position.
Figure 4:
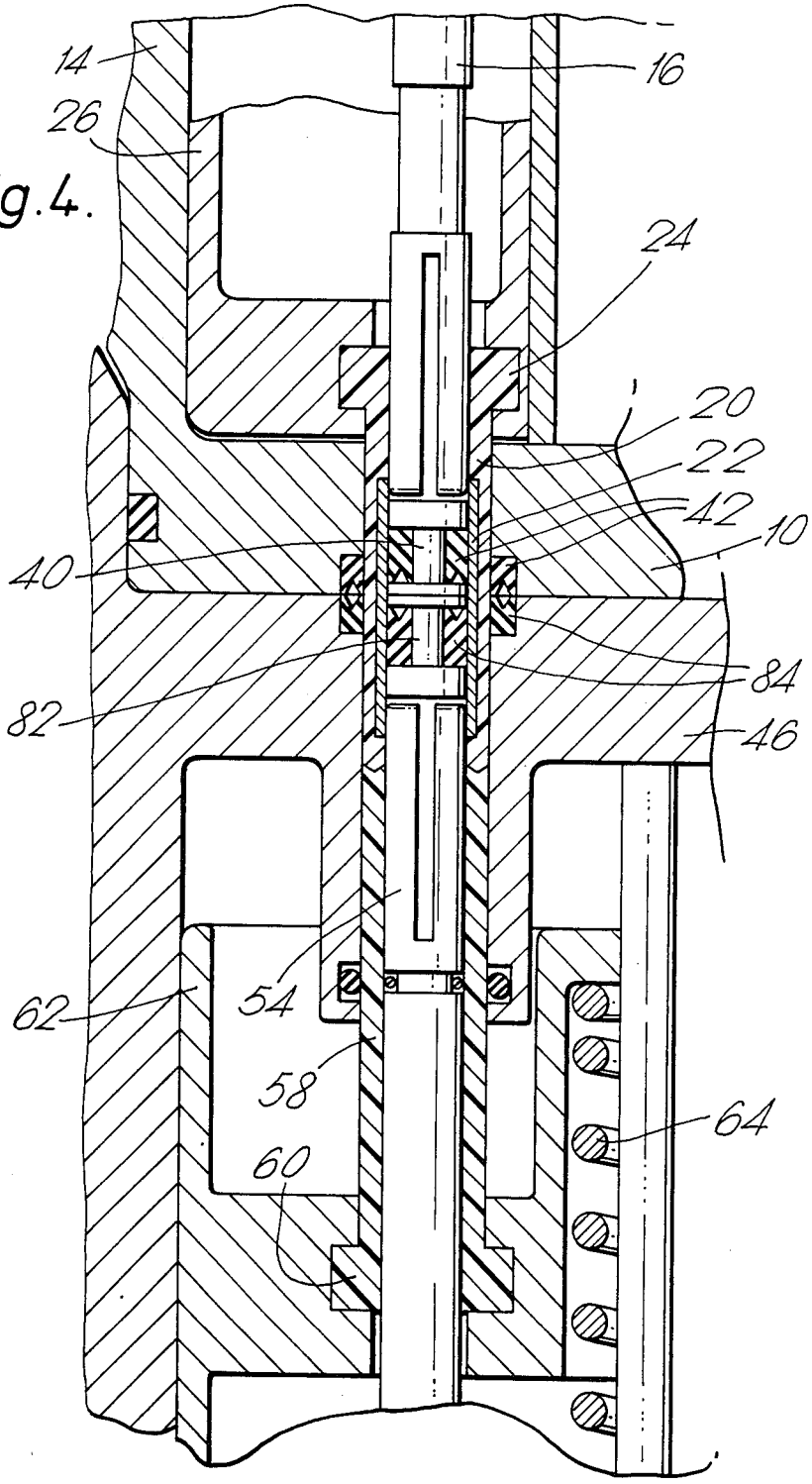
FIG. 4 is a detail of FIG. 3 on an enlarged scale.

The position described above in which the connector members 2 and 4 are connected with each other and the contact members 16 and 54 are electrically connected with each other is shown in FIGS. 3 and 4.

Figure 2:
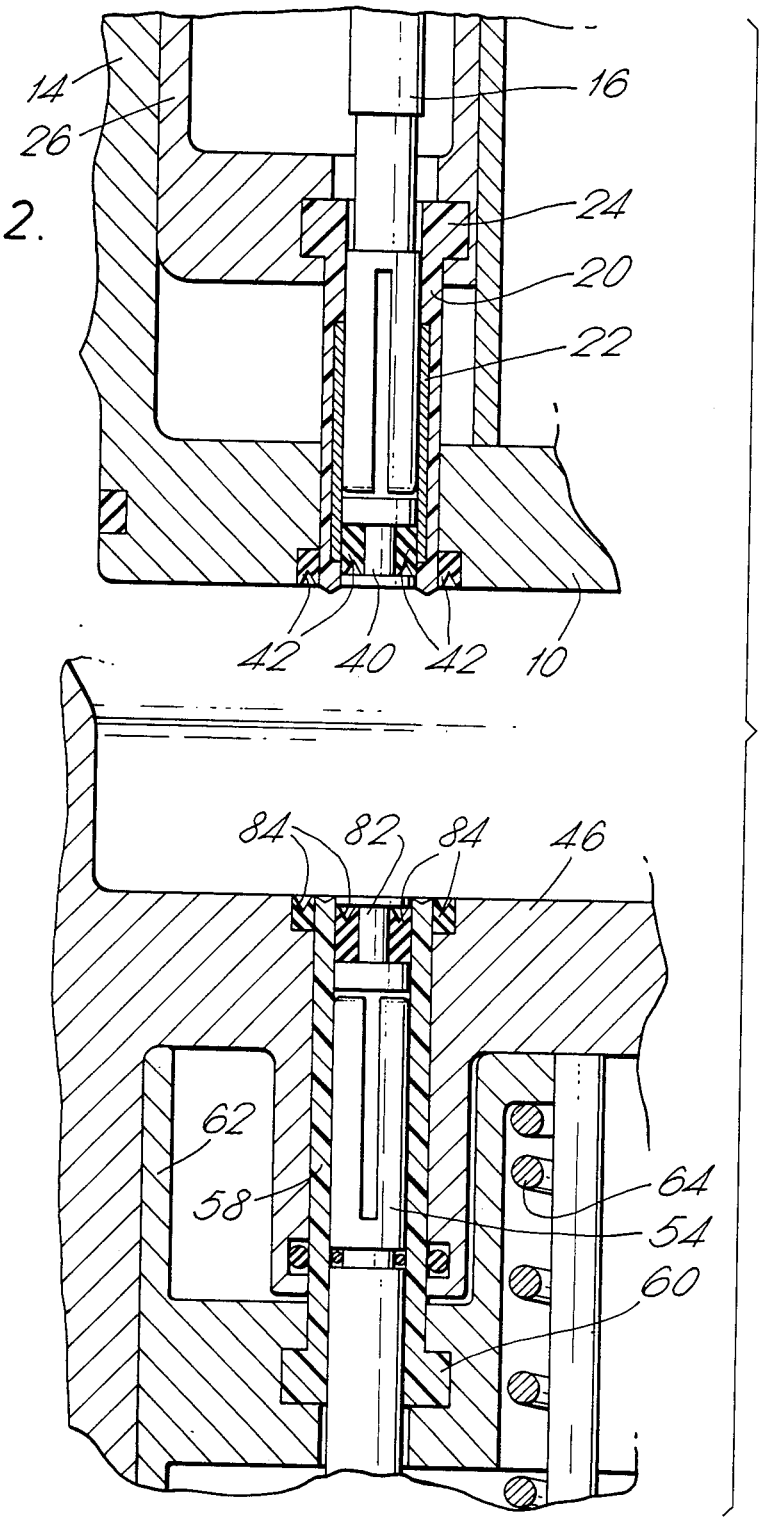
FIG. 2 shows a detail of FIG. 1 on an enlarged scale.

When the connector members 2 and 4 shall be disconnected the current to the electromagnetic device 30 is switched off, the spring 64 thereby returning the portions 20 and 58 of the sleeve to the position shown in FIGS. 1 and 2 through the inner portion 62 of the connector member 4, the electrical contact between the contact members 16 and 54 being broken in this position because of the fact that the electrically conductive portion 22 of the sleeve portion 22 has been displaced out of contact with the contact member 54.

After that, the connector members 2 and 4 can be disconnected by loosening the nut 6, the contact members 16 and 54 being thereby protected against electrical contact with the environment.

Figure 5:
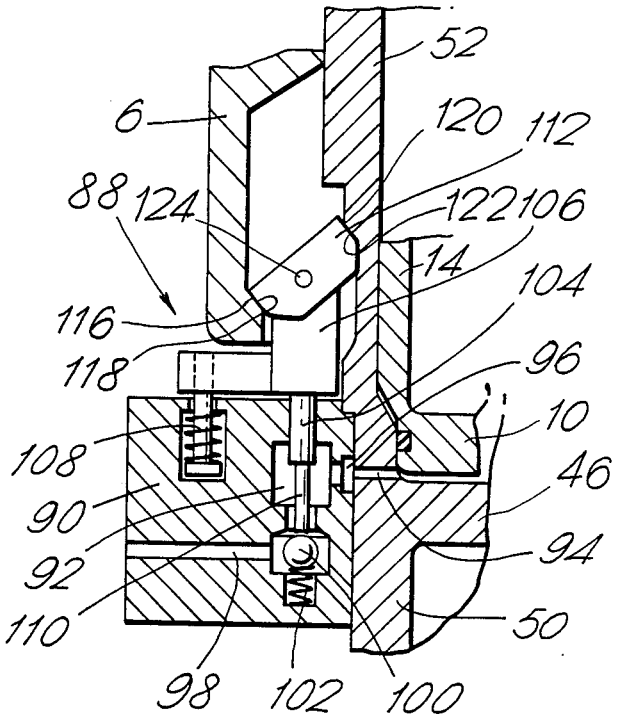
FIG. 5 is a cross-sectional view of a portion of a modified embodiment of a connector device according to the invention.

In FIG. 5 there is shown a modified embodiment of the connector device according to the invention, in which the connector device further comprises a device 88 for relieving the pressure of the water which is enclosed between the connector members when the connector members are connected with each other below the water surface.

The pressure relieving device comprises a housing 90 having a chamber 92 which is connectable with the space defined between the opposing surfaces of the end walls 10 and 46 when the connector members 2 and 4 are connected with each other. The chamber 92 is connectable with said space through a channel 94 in the projecting portion 52 of the connector member 4 and an inlet 96. The housing 90 has an outlet 98 having a connection with the chamber 92 which is controlled by a ball valve member 100 which is loaded by means of a spring 102. A piston 104 is displaceably journalled in the housing 90. The piston 104 is supported by means of a carrier 106 which is loaded by a spring 108 so that it is urged downwardly as shown in FIG. 5 and comprises a control pin 110 cooperating with the ball member 100. The carrier 106 has a catch hook 112 cooperating with the collar nut 6. The collar nut has been modified to provide a tapered ledge 116 engageable with outer surface 118 on catch hook 112. Tapered ledge 120 is also provided on part 52 of connector member 4 engageable with surface 122 on catch hook 112. Catch hook 112 is pivotably connected to carrier 106 at 124 bu suitable means. When the connector members are being connected, collar nut 6 is adjusted downwardly as viewed in FIG. 5, and passes over catch hook 112 tapered surface 120. Collar nut 6 is adjusted sufficiently downwardly so that after the surface 116 thereof has passed over catch hook 112 the latter can pivot clockwise to engage surface 122 with tapered surface 120, whereafter adjustment of collar nut 6 upwardly engages tapered surface 116 thereof with surface 118 on catch hook 112.

When the connector members 2 and 4 are connected with each other the water enclosed between the end surfaces of the end walls 10 and 46 of the connector members 2 and 4 escapes through the channel 94, the inlet 96, the chamber 92 and the outlet 98. After that, the outer water pressure remains between the connector members 2 and 4 which is not desirable. Relief of the pressure is provided by rotating the collar nut 6 in the loosening direction by about one revolution to disengage tapered surface 116 from surface 118 so that catch hook 112 is pivotable and the piston 104 and carrier 106 are displaced so far upwards that the ball 100 closes the connection between the chamber 92 and the outlet 98 and the volume of the chamber 92 which is thereby closed is increased by the fact that the piston is moved a further distance upwardly providing a relief of the pressure. After that the electrical connection of the contact members 16 and 54 with each other can be established without the necessary movement being resisted by a high pressure.

When the connector members 2 and 4 are to be separated from each other the contact between the contact members 16 and 54 is first switched off as described above whereupon the collar nut 6 is loosened by downward movement as previously described so that the engagement between the collar nut 6 and the catch hook 112 is broken allowing catch hook 112 to pivot counterclockwise so that the lower end of the collar nut can move upwardly over catch hook 112 in the reverse manner to that described above during connection of members 2 and 4. The spring 108 and the outer pressure acts on the piston 104 moving it downwardly as shown in FIG. 5 whereby the piston is returned to the position in which the control pin 110 of the piston 104 forces the ball 100 from its sealing position against the action of the spring 102. When the displacement of the connector members 2 and 4 from each other is continued the water will flow into the space between the connector members 2 and 4 through the outlet 98, the chamber 92, the inlet 96 and the channel 94.

The invention can be modified within the scope of the following claims.

I claim:

1. A connector device for connecting two electrically conductive contact members with each other comprising:

two electrically conductive contact members;

two releasably connectable connector members, one of each of said contact members being a part of a respective one of said connector members;

sleeve means having separate portions, each of said portions at least partially enclosing one of said contact members, said sleeve means being axially displaceable in relation to said contact members and said separate portions being adapted to engage each other endwise when said connector members are in the connected position;

an electrically conductive connector element mounted in one of said portions of said sleeve means in one of said connector members and displaceable therewith between a retracted position in said one connector member and a projected position partially projecting into the other of said connector members, so that said connector element electrically connects said contact members with each other only in said projected position;

piston means in each of said connector members operatively connected to respective portions of said sleeve means for displacing said sleeve means;

an electromagnetic device mounted in said one of said connector members and operatively connected to one of said piston means in said one of said connector members to selectively displace said one piston means for establishing and breaking electrical contact between said contact members when said connector members are in the connected position;

spring means operatively mounted between said other connector member and the other of said piston means for resiliently urging said other piston means toward said one connector member; and means for sealingly enclosing said contact members in said connector members comprising, insulating peg means mounted in the engageable ends of each of said portions of said sleeve means, and gasket means between said peg means and said portions of said sleeve means and between said portions of said sleeve means and said connector members.

2. A connector device as claimed in claim 1 wherein:

said electrically conducting connector element comprises a tubular sleeve mounted in sliding contact on said contact member ins aid one of said connector members.

3. A connector device as claimed in claim 1 wherein: said portions of said sleeve means have outer surfaces and end engageable portions of electrical insulating material.

4. A connector device as claimed in claim 3 wherein:

said gasket means associated with said sleeve means are positioned at the inner and outer peripheries of said separate portions of said sleeve means for sealing said contact members from the environment.

5. A connector device as claimed in claim 4 wherein:

said gasket means sealingly encloses said contact members from the environment in all positions of said contactor members.

6. A connector device as claimed in claim 1 and further comprising:

a locking device for locking said piston means in said one of said connector members against displacement during the initial period of operation of said electromagnetic device.

7. A connector device as claimed in claim 6 and further comprising:

means for relieving the pressure of a fluid enclosed between said connector members when in the connected position.

8. A connector device as claimed in claim 1 and further comprising:

means for relieving the pressure of a fluid enclosed between said connector members when in the connected position.

9. A connector device as claimed in claim 8 wherein said pressure relief means comprises:

an expansible chamber; and means connecting said expansible chamber with the space between said connector members.

* * * * *